US011794966B2

(12) United States Patent
Orjuela et al.

(10) Patent No.: US 11,794,966 B2
(45) Date of Patent: Oct. 24, 2023

(54) FOOD CONTAINER WITH TAMPER-PROOF HINGED CLOSURE

(71) Applicant: Tekni-Plex, Inc., Wayne, PA (US)

(72) Inventors: Edisson Orjuela, Chandler, AZ (US); Guillermo Angarita, Bogotá (CO); Ivan Peña, Cuautitlán Izcalli (MX); John Sierra, Chandler, AZ (US)

(73) Assignee: Tekni-Plex, Inc., Wayne, PA (US)

( * ) Notice: Subject to any disclaimer, the term of this patent is extended or adjusted under 35 U.S.C. 154(b) by 0 days.

(21) Appl. No.: 18/075,639

(22) Filed: Dec. 6, 2022

(65) Prior Publication Data

US 2023/0174280 A1 Jun. 8, 2023

Related U.S. Application Data

(60) Provisional application No. 63/286,207, filed on Dec. 6, 2021.

(51) Int. Cl.
*B65D 55/06* (2006.01)
*B65D 43/16* (2006.01)

(52) U.S. Cl.
CPC ..... *B65D 55/06* (2013.01); *B65D 43/164* (2013.01); *B65D 2401/10* (2020.05); *B65D 2401/15* (2020.05); *B65D 2401/60* (2020.05)

(58) Field of Classification Search
CPC .. B65D 55/06; B65D 43/164; B65D 2401/10; B65D 2401/15; B65D 2401/60; B65D 2543/00324
See application file for complete search history.

(56) References Cited

U.S. PATENT DOCUMENTS

| | | | | |
|---|---|---|---|---|
| 7,694,837 | B2 | 4/2010 | Robertson et al. | |
| 8,028,851 | B2 | 10/2011 | Vovan et al. | |
| 8,056,750 | B2 | 11/2011 | Vovan | |
| 8,251,249 | B1 * | 8/2012 | Vovan | B65D 43/021 220/523 |
| 8,584,887 | B2 | 11/2013 | Segal | |
| 8,608,008 | B2 | 12/2013 | Gingras et al. | |
| 8,757,416 | B2 | 6/2014 | Golota et al. | |
| 8,807,385 | B1 | 8/2014 | Fosse | |
| 8,851,315 | B2 | 10/2014 | Vovan | |
| 9,120,595 | B2 | 9/2015 | Chou | |
| 9,156,595 | B2 | 10/2015 | Pace et al. | |
| 9,315,302 | B2 | 4/2016 | Stone et al. | |
| 9,592,937 | B1 | 3/2017 | Wang | |
| 9,676,527 | B2 | 6/2017 | McCumber | |
| 9,708,106 | B2 | 7/2017 | Vovan | |
| 9,745,106 | B2 | 8/2017 | Siskindovich et al. | |
| 9,828,149 | B2 | 11/2017 | Wang | |
| 9,994,369 | B2 | 6/2018 | Myer | |
| 10,266,312 | B2 | 4/2019 | Fosse | |
| 10,301,080 | B2 | 5/2019 | Lotfi | |
| 10,384,843 | B2 | 8/2019 | Vovan et al. | |
| 10,427,842 | B2 | 10/2019 | Siskindovich et al. | |
| 10,494,161 | B2 | 12/2019 | Fosse | |
| 10,723,524 | B2 | 7/2020 | Schoen et al. | |

(Continued)

FOREIGN PATENT DOCUMENTS

WO 20200041385 A1 2/2020

*Primary Examiner* — James N Smalley
(74) *Attorney, Agent, or Firm* — Polsinelli, P.C.

(57) ABSTRACT

A one-piece molded food container having a lid, a base and a tamper-evident hinged element connecting the lid and base.

16 Claims, 14 Drawing Sheets

(56) References Cited

U.S. PATENT DOCUMENTS

| | | | | |
|---|---|---|---|---|
| 10,894,635 | B2 * | 1/2021 | Helm | B65D 43/0256 |
| 2006/0289549 | A1 * | 12/2006 | Vovan | B65D 55/024 220/377 |
| 2009/0090712 | A1 * | 4/2009 | Vovan | B65D 21/02 220/793 |
| 2010/0102074 | A1 * | 4/2010 | Parikh | B65D 41/32 220/810 |
| 2019/0185221 | A1 * | 6/2019 | Allers | B65D 43/0249 |
| 2020/0062461 | A1 | 2/2020 | Smith et al. | |
| 2020/0115117 | A1 | 4/2020 | Krikheli et al. | |
| 2022/0041343 | A1 * | 2/2022 | Geiger | B65D 21/0222 |

* cited by examiner

T (vertical)
ecA
10
11
12
16
17
5
19
18
13
14
15 (in TRP)
17
13 (in BRP)
T
60
62
63
64
68
69
61
7°
42P
45
44
46
47
43
40
42

Push in the indicated mark to break the dotted flap.

Lift the tab upward, opening the container

Continue lifting the lid until it is fully opened.

FOOD CONTAINER WITH TAMPER-PROOF HINGED CLOSURE

FIELD OF THE INVENTION

The present invention relates to plastic containers, and in particular to a one-piece as-molded container comprising a base and lid connected by a tamper-proof hinged connecting element.

BACKGROUND

Food containers having a base and lid joined by a hinge connection are commonly referred to as a "clamshell" container. This type of container is in widespread use for takeout, delivery, grab-and-go, deli and bakery counter use (e.g., sandwich shops and grocery stores with self-service buffets). The clamshell container is relatively inexpensive to produce, readily stacked in a space efficient manner, and when made of solid plastic (non-foam) material is sufficiently rigid to withstand handling and transport, both filled and empty, and is impervious to liquids and moisture. The latter two features are significant benefits in contrast to paperboard or opaque plastic foam clamshell containers. Clear and rigid solid plastic containers also provide for visual display and identification (by both the vendor and consumer) of the enclosed contents, and allow for repeated opening and closing (e.g., allowing the consumer to repeatedly open the container and remove (eat) some of the contents, and then reseal the container leaving the remaining portion(s) for later consumption.

SUMMARY OF THE INVENTION

It would be desirable to provide a clamshell-type container having a tamper-evident closure element that would allow both the vendor and the consumer to know, prior to purchase, that the filled container has not been opened by another.

It would also be desirable to provide a tamper-evident closure that does not generate additional components for disposal (e.g., a tear off strip).

It would also be desirable to provide a tamper-evident closure that is intuitive to open by pulling or pushing the closure, such as a ring-type flange.

It would also be desirable to provide a tamper-evident closure that is re-closable with a secure fit, allowing the container to be reopened easily, again by pulling on the ring-type flange.

In accordance with one embodiment of the present invention there is provided a one-piece solid plastic thermoformed container comprising a base 10 and a lid 40 connected by a tamper-evident hinged element 60. The hinged element comprises a foldable base flange 61 having a base hinge 68, and a foldable lid flange 69 having lid hinge 70; a foldable ring tab or loop element 62 is provided on the lid flange having frangible connections FC to the base flange. The container has mating lid and base rims 44, 12 for resealable closing of the base and lid. The base has a recess 11 configured to receive a food, or a non-food product. The container design is adapted for ease of initial closing, subsequent initial opening, reclosing and further reopening.

In one embodiment, the tamper-evident hinged element remains connected to the base and the lid upon opening (thus not creating an additional waste product for disposal).

In one embodiment, in the initial closed container position, the lid flange with foldable ring tab is disposed between opposing base flanges that obstruct the passage of an any element into the hinge, thus insuring tamper-proof resistance.

In one embodiment, to initially open the closed container from the initial closed position, the base is held by the base flanges on either side of the tamper-evident hinged element, and at the same time the ring tab is unfolded by pulling upwardly, to break (tear) the frangible connections between the lid and base flanges, thus separating the base form the lid. The breakage of the pre-cut frangible connections, leaves the base and lid flanges connected to the base and lid respectively, serving as evidence for the final consumer that the container was opened. In another embodiment, the ring tab is configured for an initial push-down movement to initiate opening of the container.

In one embodiment, the one-piece container design is adapted for ease of cutting (i.e., vertical cutting) to form the one-piece container (with lid, base and tamper-evident hinged element). For example, after thermoforming and while still in the thermoforming mold or following removal from the mold, the molded container enables one-directional (vertical) cutting to form the perimeters of the lid, base and hinged element.

In one embodiment, a tamper-evident and re-closable container comprising:

- a molded single-piece container comprising a base, a lid and a tamper-evident hinged element with frangible connecting portions connecting the base and lid in an initial as-molded open position, the frangible connecting portions when broken allowing separation the base and lid and providing tamper evidence that the container has been previously opened;
- the lid and base being movable between:
  - a) the initial as-molded open position with the lid and base being connected by the hinged element and allowing the base to be filled with a product;
  - b) an initial closed position with the lid positioned over and temporarily sealed to the base to enclose a product in the closed container, the hinged element allowing relative rotational movement of the base and lid from the initial open position to the initial closed position;
  - c) an opened position, subsequent to the initial closed position, in which the frangible connecting portions of the hinged element have been broken allowing the base and lid to be separated to allow removal of a product from the base and providing tamper evidence that the container has been opened; and
  - d) a further closed position, subsequent to the opened position, in which the separate base and lid can be resealed to allow storage and subsequent opening of the closed container;
- the tamper-evident hinged element comprising mating flanges on perimeter portions of the lid and base that are initially connected by the frangible connecting portions, the mating flanges on the lid and base further comprising hinges that allow for the relative rotational movement of the base and lid from the initial as-molded open position to the initial closed position, the mating flanges including a foldable ring tab having an outer perimeter and foldable extensions adjacent opposing sides of the ring tab outer perimeter, the ring tab outer perimeter being partially formed by the frangible connecting portions for connecting the foldable extensions to the ring tab outer perimeter, the ring tab being configured to be grasped by a user to enable the user to pull the lid from the base and break the frangible connecting portions.

In one embodiment of the tamper-evident and re-closable container, the mating flange on the base comprises a fixed support on the base perimeter and the foldable extensions, the foldable extensions being disposed on opposing ends of the fixed support, and the mating flange on the lid comprises the foldable ring tab.

In one embodiment of the tamper-evident and re-closable container, the mating flange on the lid comprises hinges for folding the ring tab in the closed position and unfolding the ring tab in the opened position, and the mating flange on the base comprises hinges for folding the extensions in the closed position and unfolding the extensions in the opened position.

In one embodiment of the tamper-evident and re-closable container, the frangible connecting portions are disposed on adjacent portions of the mating lid and base flanges and between the respective hinges of the mating flanges.

In one embodiment of the tamper-evident and re-closable container, a bottom wall of the base lies in a horizontal base reference plane BRP, an outer folded portion of the ring tab is disposed downwardly transverse to the BRP in the closed position, and the outer folded portion of the ring tab is lifted by pulling outwardly and upwardly away from the lid perimeter to break the frangible connecting portions.

In one embodiment of the tamper-evident and re-closable container, the mating flange on the lid comprises two sets of hinges for folding the ring tab in the closed position and unfolding the ring tab in the opened position, and the mating flange on the base comprises two sets of hinges for folding the extensions in the closed position and unfolding the extensions in the opened position.

In one embodiment of the tamper-evident and re-closable container, the frangible connecting portions are disposed on adjacent portions of the base flange and a folded portion of the ring tab in the closed position.

In one embodiment of the tamper-evident and re-closable container, a bottom wall of the base lies in a horizontal base reference plane BRP, the folded portion of the ring tab and the frangible connecting portions are disposed parallel to the BRP in the closed position, wherein the folded portion of the ring tab is pushed down toward the base plane to break the frangible connections.

In one embodiment of the tamper-evident and re-closable container, the extensions on the base flange are folded and the distal portions thereof are disposed in a top reference plane, parallel to the BRP, in the closed position, and frangible connecting portions are disposed between the folded base extensions and the lid flange, wherein the frangible connections on the folded base extensions are broken by pulling the unfolded ring tab upwardly away from the BRP.

In one embodiment of the tamper-evident and re-closable container, the mating flange on the lid remains attached to the lid when the frangible connecting portions are broken, and the mating flange on the base remain attached to the base when the frangible connecting portions are broken.

In one embodiment of the tamper-evident and re-closable container, the lid and base include re-sealable rims for sealing and unsealing of the lid to the base.

In one embodiment of the tamper-evident and re-closable container, the ring tab on the lid is pulled upwardly away from the base plane for subsequent removal of the lid from the base by separating the re-sealable rims.

In one embodiment of the tamper-evident and re-closable container, the as-molded container is formed in the open position, with a bottom wall of the base lying in a horizontal base reference plane, and a top wall of the lid lying in a top reference plane that is parallel to the base reference plane.

In one embodiment of the tamper-evident and re-closable container, the ring tab and base flange are folded about the hinges on the lid flange and base flange to close the lid over the base in the initially closed position.

In one embodiment of the tamper-evident and re-closable container, the base and lid perimeters are rounded or rectangular.

In another embodiment of the tamper-evident and re-closable container, a method of forming a tamper-evident and re-closable container comprising:

molding a single-piece container comprising a base, a lid and a tamper-evident hinged element, forming in the mold, or after molding, frangible connecting portions connecting the base and lid in an initial as-molded open position, the frangible connecting portions when broken allowing separation the base and lid and providing tamper evidence that the container has been previously opened;

the tamper-evident hinged element comprising mating flanges on perimeter portions of the lid and base that are initially connected by the frangible connecting portions, the mating flanges on the lid and base further comprising hinges that allow for the relative rotational movement of the base and lid from the initial as-molded open position to an initial closed position, the mating flanges including a foldable ring tab having an outer perimeter and foldable extensions adjacent opposing sides of the ring tab outer perimeter, the ring tab outer perimeter being partially formed by the frangible connecting portions for connecting the foldable extensions to the ring tab outer perimeter, the ring tab being configured to be grasped by a user to enable the user to pull the lid from the base and break the frangible connecting portions.

the lid and base being movable between:

a) the initial as-molded open position with the lid and base being connected by the hinged element and allowing the base to be filled with a product;

b) the initial closed position with the lid positioned over and temporarily sealed to the base to enclose a product in the closed container, the hinged element allowing relative rotational movement of the base and lid from the initial open position to the initial closed position;

c) an opened position, subsequent to the initial closed position, in which the frangible connecting portions of the hinged element have been broken allowing the base and lid to be separated to allow removal of a product from the base and providing tamper evidence that the container has been opened; and d) a further closed position, subsequent to the opened position, in which the separate base and lid can be resealed to allow storage and subsequent opening of the closed container.

BRIEF DESCRIPTION OF THE FIGURES

Various embodiments of the invention will now be described and illustrated in the accompanying drawings wherein:

FIGS. 1A-1B show the base 10 and lid 40 in an initial as-molded open position (prior to filling and closure) wherein the lid and base hinges 70, 68 (of the lid and base flanges) are disposed lying flat (not bent) in a horizontal plane parallel to a base reference plane BRP;

FIGS. 1-6 illustrate the relative rotational movements of the lid flange 69 with respect to the base flange 61 from a starting position in the same horizontal plane as shown in FIGS. 1A-1B, and continuing through increasing rotational movements in FIGS. 2A-2B, 3A-3B and 4A-4B, until the lid and base flanges 69, 61 each reach a final closed position shown in FIGS. 5A-5B where the lid rim 44 is fully closed onto the base rim 12; in the final closed position of FIGS. 5A-5B, an outer folded ring portion 65 of the lid flange has been rotated 90 downwardly (toward the BRP) to a transverse vertical down position, and each of a pair of foldable distal base tabs 67A and 67B on the base flange (and disposed distally of a respective base hinge 68A, 68B) has been rotated 90 upwardly degrees up to a vertical up position;

FIGS. 5A and 5B are top front perspective and enlarged views of the same one-piece food container assembly 5 and tamper-evident hinged element 60 respectively of FIGS. 1A-1B through 4A-4B, but in a subsequent initially closed position, while

FIG. 8B is an enlarged fragmentary view of the tamper-evident hinged element connecting the base and lid, wherein FIGS. 8A-8B show the base and lid in a starting open position similar to FIGS. 1A-1B (prior to filling and closure);

FIGS. 9A-9C show another embodiment of a one-piece food container assembly according to a third embodiment, having a square shaped periphery, an initial "push-down" (to open) folded ring tab, and further extensions on the base flanges of the tamper-evident hinged element, wherein FIG. 9A is a top perspective view of the initially closed container, FIGS. 9B-9C are top perspective views of the container of FIG. 9A showing an initial step of pushing down on the outer portion 265 of the ring tab to begin opening of the container.

DETAILED DESCRIPTION

Figures 1A, 1B:
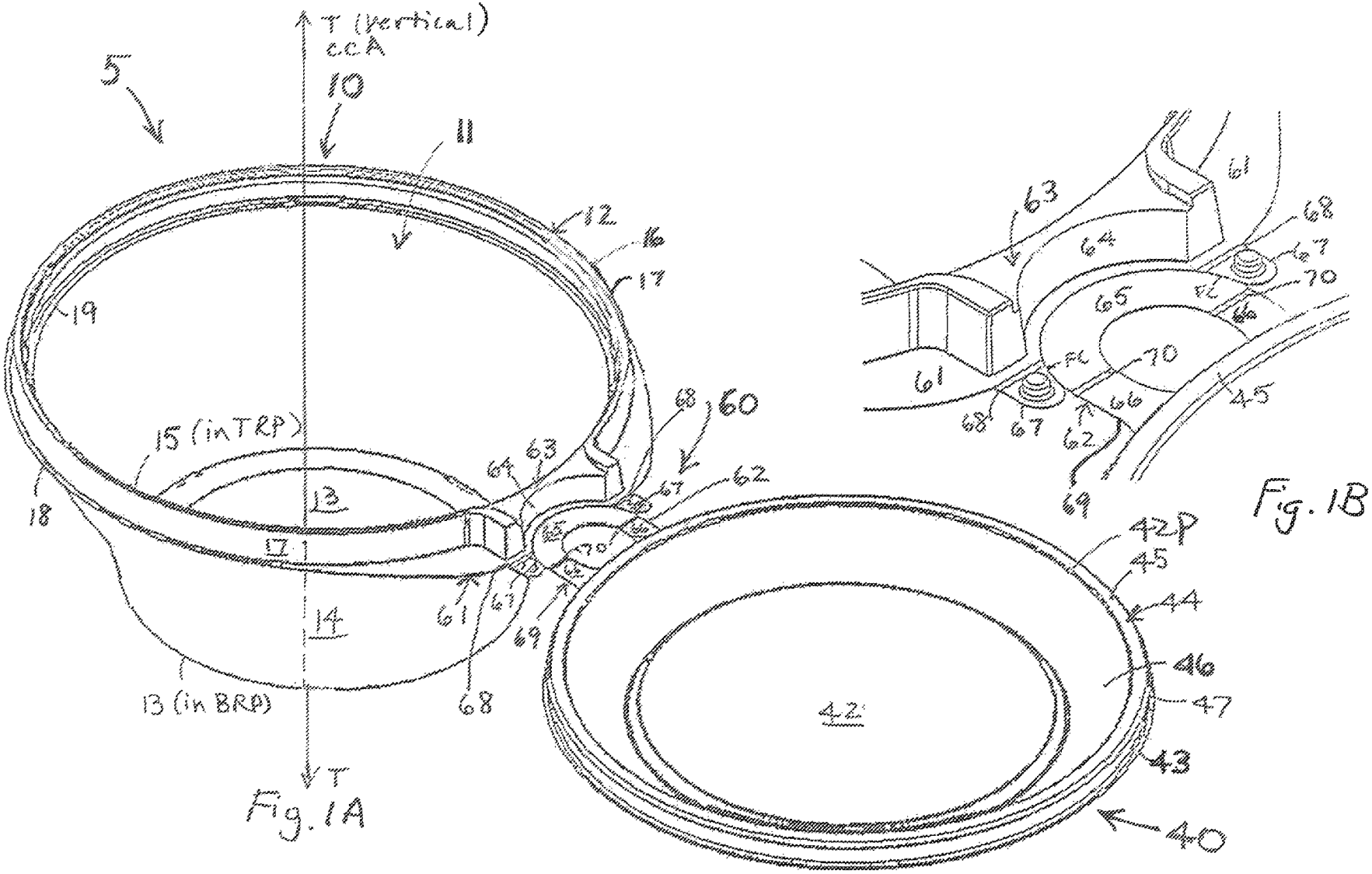
FIG. 1A is a top front perspective view of a one-piece food container assembly 5 according to one embodiment of the invention.
FIG. 1B is an enlarged fragmentary view of the tamper-evident hinged element 60 connecting the base and lid in FIG. 1A.
Figures 2A, 2B:
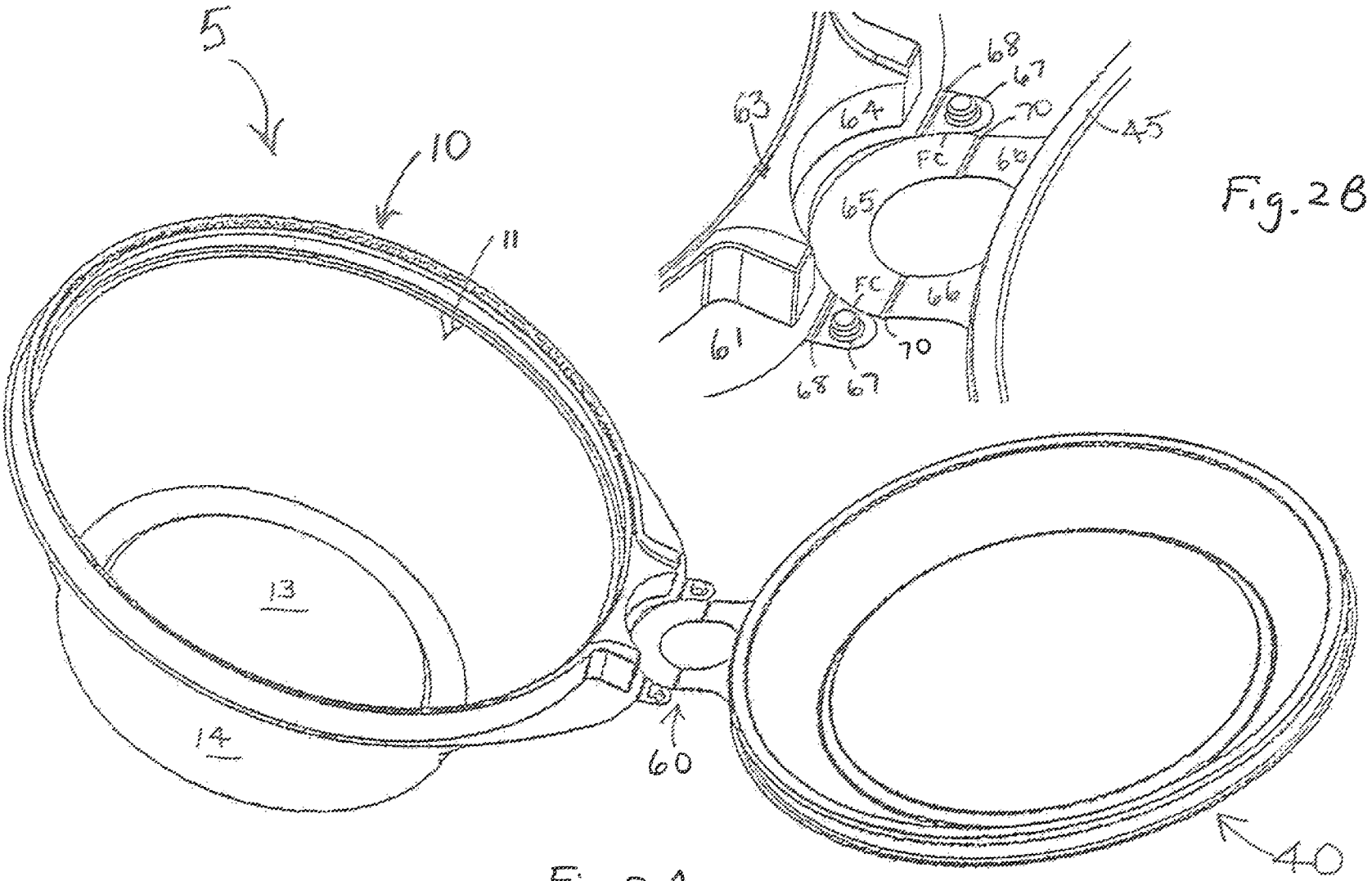
FIGS. 2A and 2B are top front perspective and enlarged views of the same one-piece food container assembly and tamper-evident hinged element respectively of FIGS. 1A and 1B, but in a subsequent first mid-closing position (it being assumed but not shown that the container base would first be filled with a food product, prior to initiating closure of the base and lid)
Figure 3B:
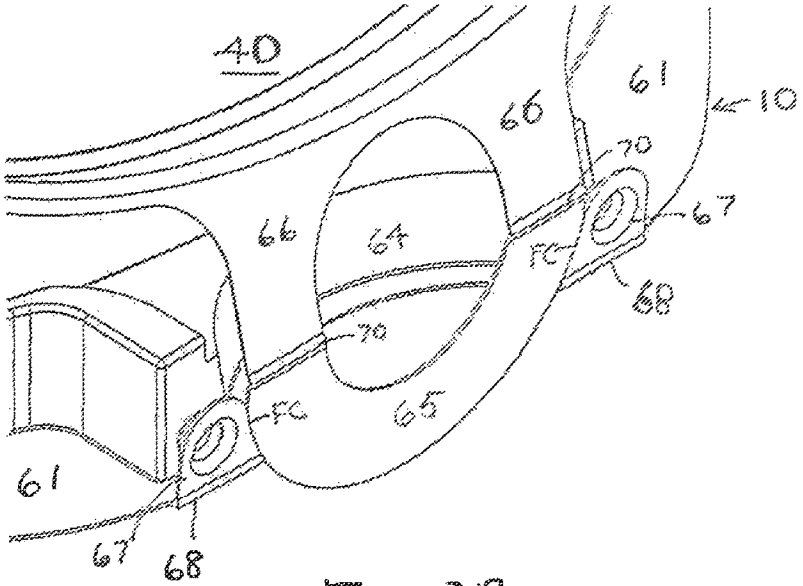
FIGS. 3A and 3B are top front perspective and enlarged views of the same one-piece food container assembly 5 and tamper-evident hinged element 60 respectively of FIGS. 1A-1B and 2A-2B, but in a subsequent second mid-closing position.
Figure 3A:
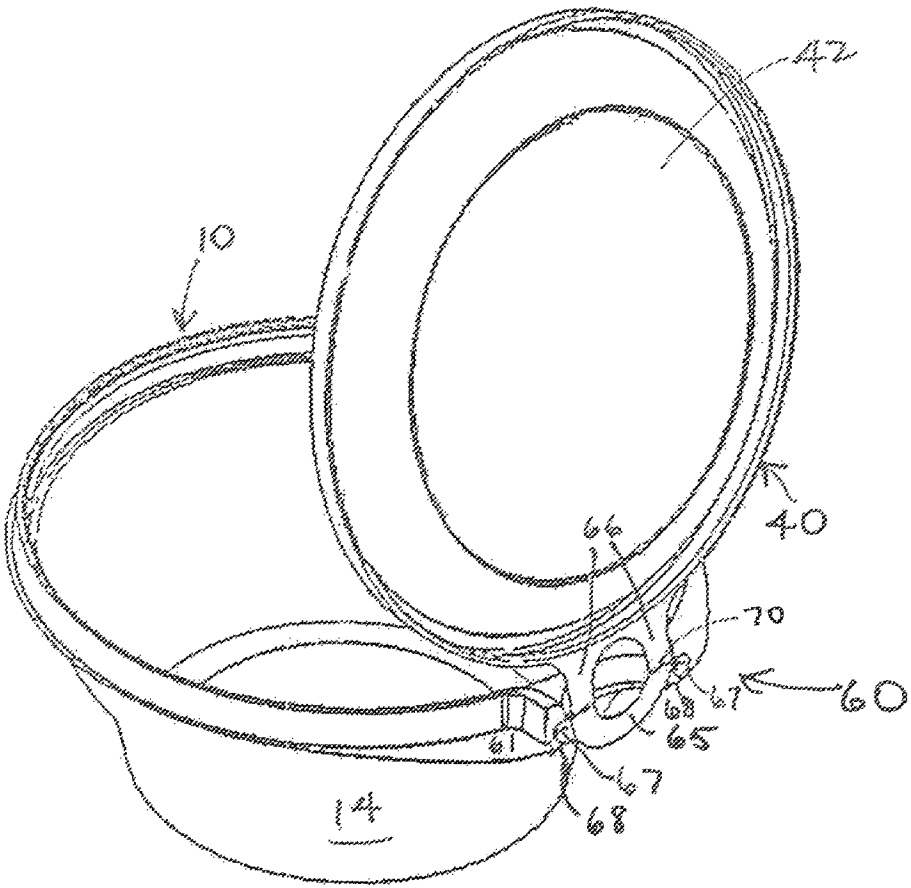
Figure 4B:
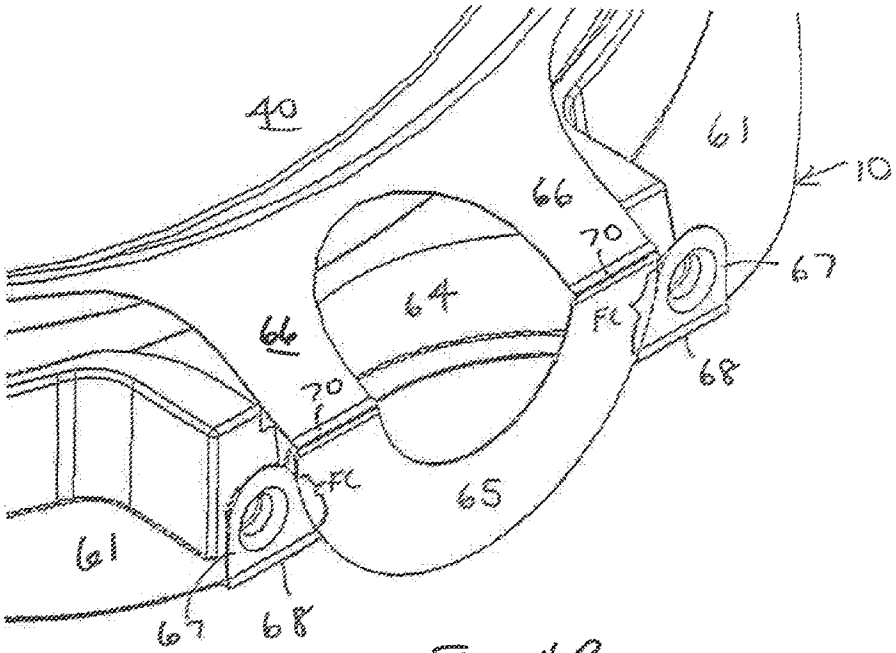
FIGS. 4A and 4B are top front perspective and enlarged views of the same one-piece food container assembly 5 and tamper-evident hinged element 60 respectively of FIGS. 1A-1B through 3A-3B, but in a subsequent third mid-closing position.
Figure 4A:
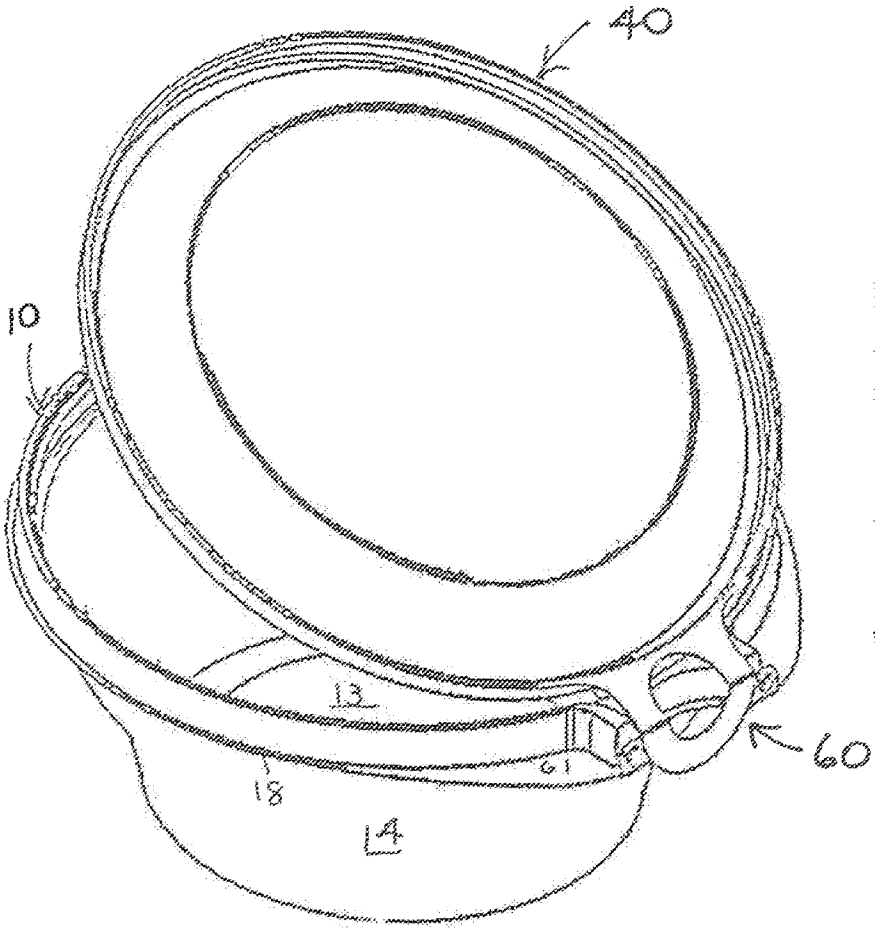
Figure 5B:
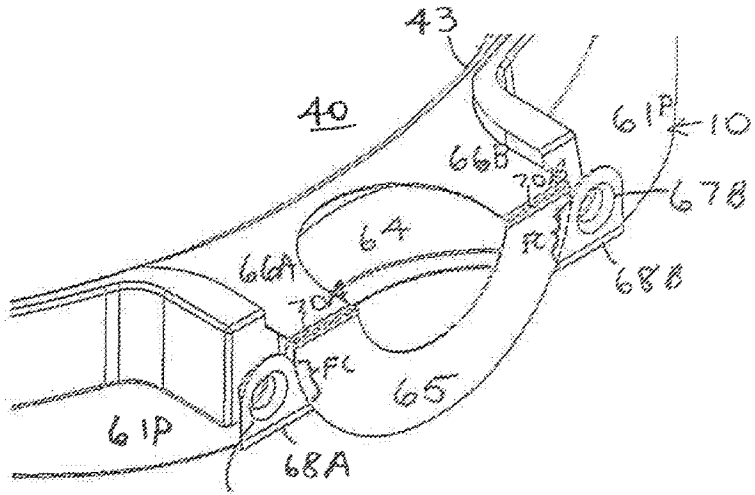
Figure 5A:
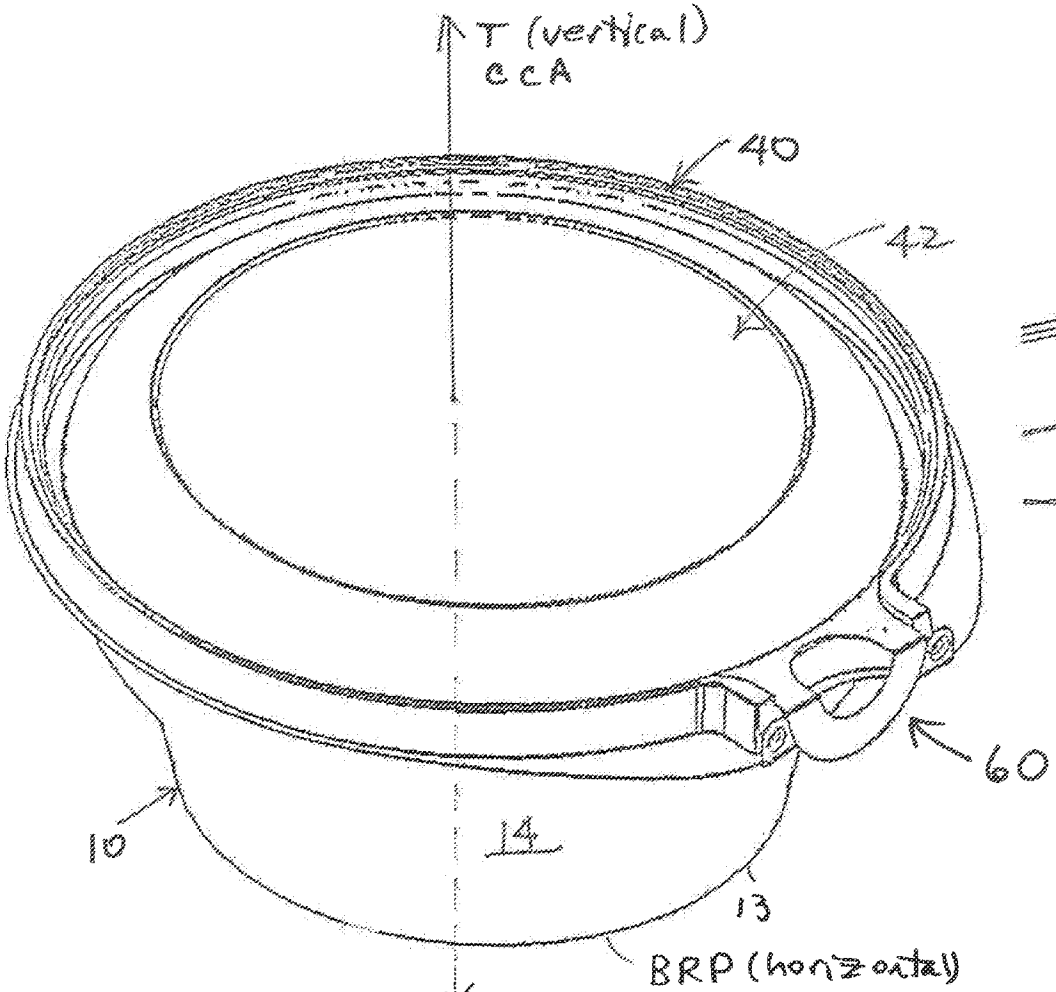
Figure 5C:
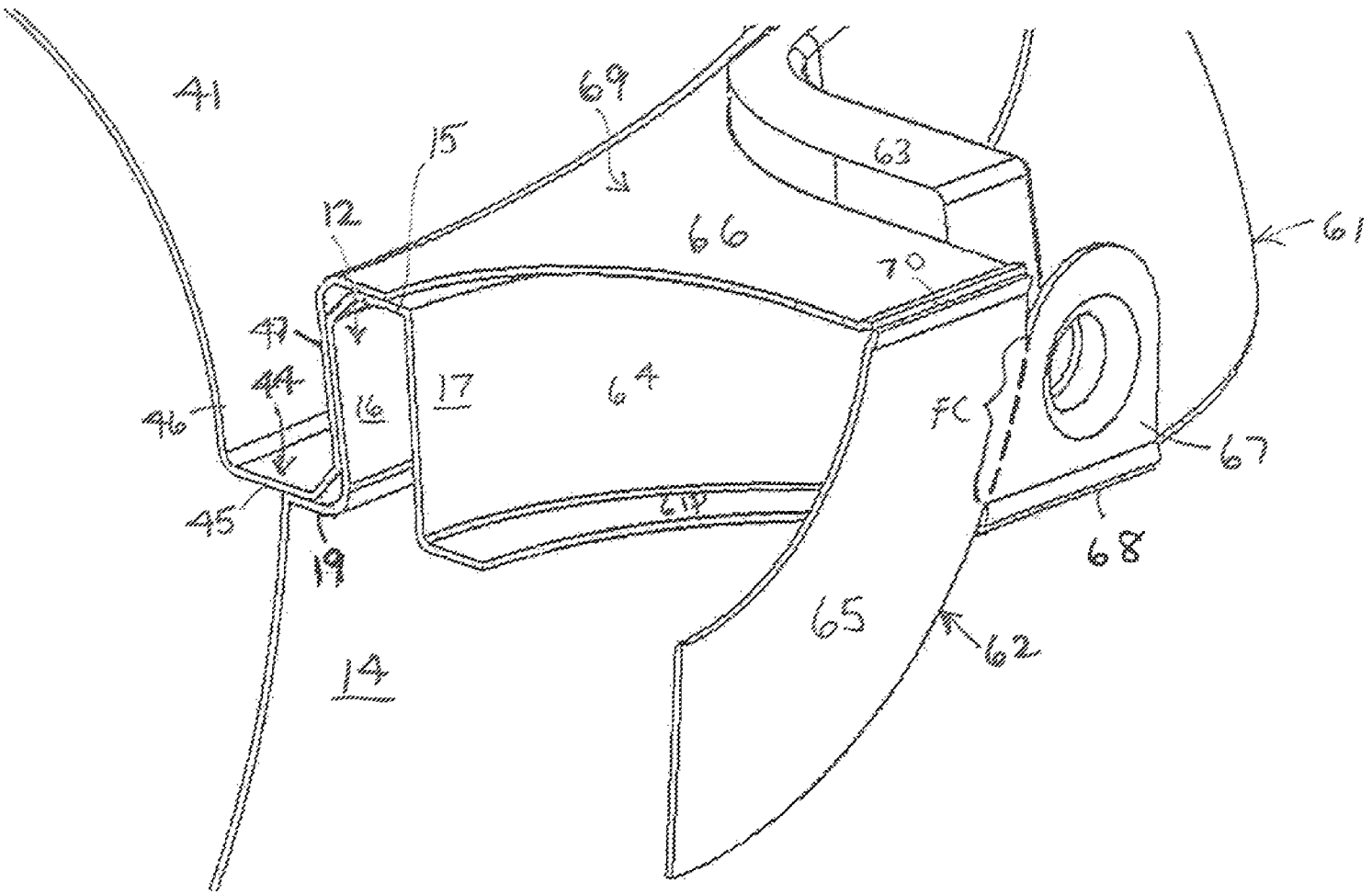
FIG. 5C is a further enlarged and sectional view of the tamper-evident hinged element 60 in the closed position.

According to various embodiments of the invention described in the text and illustrated in the figures, a one-piece as-molded container 5 (preferably solid plastic thermoformed container) is provided comprising a base 10 and lid 40 with a tamper-evident hinged element 60 connecting the base and lid. The hinged element comprises a hinged base flange 61, a hinged lid flange 69, and a foldable ring tab 62 on the hinged lid flange 69 having frangible connections FC to the hinged base flange 61. The base has a recess 11 configured to receive a food, or a non-food product, and the container has mating re-sealable lid and base rims 44, 12 for resealable closing of the base and lid (after the initial opening). During initial opening of the sealed container, the hinged flanges are broken along the frangible connections resulting in a two-piece container, with the lid and base flanges remaining connected to the lid and base respectively. The broken frangible connections of the hinged element provide tamper-proof evidence that the container has been opened.

The various embodiments of the invention disclosed herein include one or more of the following components and/or variables and/or reference planes (with subsequent embodiments provided with similar reference numbers in a 100, 200 and 300 series):

- 5 a container assembly,
- 10 a base of the container assembly, comprising:
  - 11 a cup-shaped base recess for holding a product (e.g., food product),
  - 12 a base rim, at open top end of the base,
  - 13 a closed bottom wall of the base recess, lying in a base reference plane BRP,
  - 14 a sidewall of the recess 11,
  - 15 a top wall of the recess, lying in a top reference plane TRP, parallel to BRP,

16 an inner wall of base rim 12, transverse to BRP
17 an outer wall of base rim 12, transverse to BRP
18 an outer peripheral lip on the base, lying parallel to BRP,
19 an inner lip on the base rim 12, parallel to BRP
40 a lid of the container assembly, comprising:
42 a closed lid top wall, configured to cover the base recess 11,
43 an outer peripheral lip on the lid,
44 a lid rim, at the open top end of the lid, for engaging the base rim 12,
45 a top rim wall of the lid rim 44,
46 an inner rim wall of the lid rim 44,
47 an outer rim wall of the lid rim 44,
60 a tamper-evident hinged element connecting the base 10 and lid 40 in the as-molded and initial closed positions, comprising:
61 a base flange,
62 a folded ring tab or loop, for finger engagement, on the lid flange 69,
63 a fixed support element on the base flange,
64 an arched support wall of element 63, protecting the folded ring tab 62,
65 an outer/distal portion of folded ring tab 62,
66 an inner/proximal portion of folded ring tab 62,
67 a tab on the base flange, distal of base hinge 68
68 a hinge on the base flange 61,
69 a lid flange,
70 a hinge on the lid flange 69,
BRP horizontal base reference plane, in which bottom wall 13 of base/recess lies,
T vertical direction, transverse to BRP
CCA vertical central container axis, aligned with T,
TRP horizontal top reference plane, parallel to BRP, in which top wall 15 of base lies,
FC frangible connection.

FIGS. 1-7

As shown in FIGS. 1-7, a first embodiment comprises a one-piece clear solid plastic thermoformed plastic food container assembly 5 comprising a base 10, a lid 40 and a tamper-proof hinged closure element 60 connecting the base and lid.

The container base 10 includes:

a cup-shaped thermoformed recess 11 (for receiving food and/or a non-food product) having an open top end surrounded by a top base rim 12, a closed bottom wall 13, and a closed sidewall 14 extending upwardly from the bottom wall to the rim;

the bottom wall 13 lies in a horizontal base reference plane BRP and the cup-shaped sidewall 14 extends upwardly (in the vertical direction transverse T to the BRP) from the closed bottom wall 13 to the open top end rim 12, the cup-shaped sidewall 14 flares radially outwardly from a first diameter defining the bottom wall periphery 13P to a second diameter, greater than the first diameter, at the open top end defined by the rim periphery 12P; in the present embodiment the base and lid each have a generally circular periphery with respect to a vertical central container axis CCA aligned with the transverse direction T;

the base rim 12 includes: a base top wall 15 aligned in a horizontal top reference plane TRP parallel to the BRP, a vertical rim wall extending downwardly from the top wall 15 having an inner rim wall surface 16 and an outer rim wall surface 17 each aligned in the transverse direction T, an outer lip 18 that extends radially outwardly (horizontally) from the outer rim wall surface 17 to form a peripheral shoulder or lip 18 parallel to the BRP (that can be grasped by a user to facilitate separating the base and lid rims), and an inner lip 19 that sits below the top wall 15, lies parallel to the BRP, and is configured to engage (sit below and in contact with) a bottom rim wall 46 on the lid 40 to releasably seal (via a pressure fit) the bae and lid rims 12, 44 together.

The container lid 40 includes:

a closed top lid wall 42 having a perimeter 42P;

a lid rim 44 comprising a top rim wall 45 that extends radially outwardly (with respect to the vertical central container axis CCA) from the top wall perimeter 42P, the top rim wall 45 being aligned parallel to the BRP (when the lid rim 44 engages the base rim 12 in the closed container position as shown in FIGS. 5-6);

the lid rim 44 including an outer rim wall 47 extending in the vertical transverse direction T (when the lid is closed over the base, and a peripheral lip 43 extending radially outwardly from 47 and lying parallel to the BRP in the closed position.

The tamper-proof closure element 60 includes a base flange 61 and a lid flange 69 as follows:

the base flange 61 comprising:

a central fixed support element 63 extending upwardly (in the transverse direction T) from the base lip flange 61 to the top wall 15 and spanning all or a portion of the base flange 61, the support element including a central vertical support wall 63 (here having a radial outwardly front face in an arch shape 64) that forms an opening for the outer foldable portion 65 of the ring tab 62 on the lid flange, and a pair of spaced-apart proximal end flange portions 61P each connecting to a hinge 68 and distal tab or extension 67, the lid hinge flange 69 comprising:

two spaced-apart inner/proximal flange portions 66A, 66B of the ring tab 62 that extend radially outwardly from the lid periphery and connecting, via a respective one of the lid hinges 70A, 70B, to opposite ends of the distal loop portion 65; the flange portions 66 initially lie horizontally (parallel to the BRP) within a space defined by the front face 64 of the arched wall 63 on the bae flange; frangible connections FC are disposed between the outer ring tab portion 65 and the base flange distal tabs 67A, 67B.

FIGS. 1-7 illustrate a food container according to one embodiment of the invention, the one-piece food container assembly comprising a base, a lid and a tamper-proof hinged closure element connecting the base and lid. In particular, FIGS. 1-5 are laid out as a series of steps showing the container assembly in the initially open position and progressing through an initial closing of the lid and base with the tamper-proof closure element intact, and then progressing through an opening of the lid and base (FIGS. 6-7) wherein one or more frangible connections FC of the tamper-proof closure element are broken, separating the lid and base into two separate elements, enabling the lid and base to be opened, and thereafter serving as proof that the lid and base have been previously opened. In summary, the use steps include the following:

1. As manufactured (thermoformed) and followed by any vertical cutting (e.g., to form the frangible connections FC), the lid and base and tamper-proof closure element form one integral article; a plurality of such articles can be stacked one on top of the next, with the recess portions 11 of the base nestled one within the other, and the lid top walls 42 nestled one within the other: FIGS.

1A-1B shows one such initial container article 5 with the lid and base in the fully open position, wherein the base and lid lip flanges, hinges, loop, and base tabs all open and lying flat in a horizontal plane parallel to the BRP.

Figure 6B:
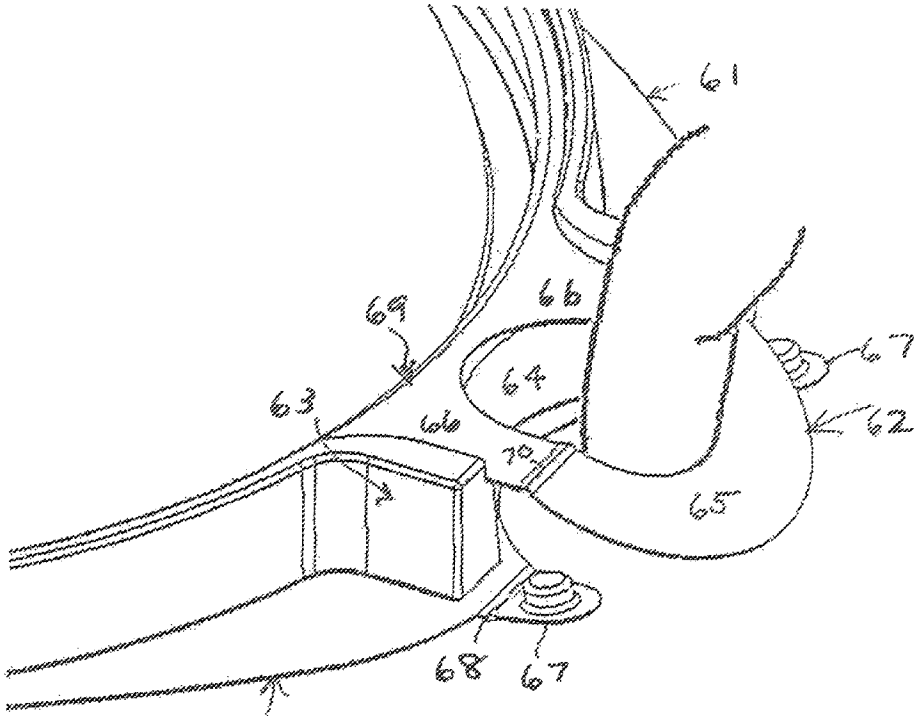
FIGS. 6A and 6B are enlarged views of the initially closed tamper-evident element 60 of FIGS. 5A-5C, but showing two subsequent sequential steps of initiating opening of the tamper-evident element by first inserting a finger in the folded ring opening (FIG. 6A) and then engaging the folded ring portion 65 (with the inserted finger) and pulling radially outwardly and vertically upwardly on such ring portion 65 (FIG. 6B), away from the container and lid periphery, so as to break the frangible connections FC between the lid flange 69 and the base flange 61 on opposing sides of the ring perimeter (thereby creating separate lid and base components 10, 40 as shown in FIG. 7)
Figure 6A:
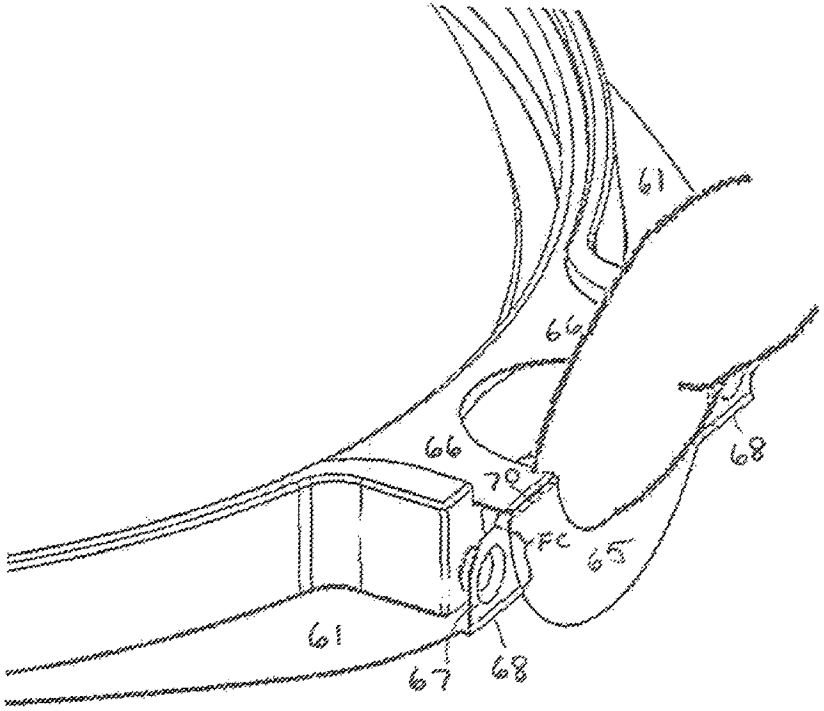
Figure 7:
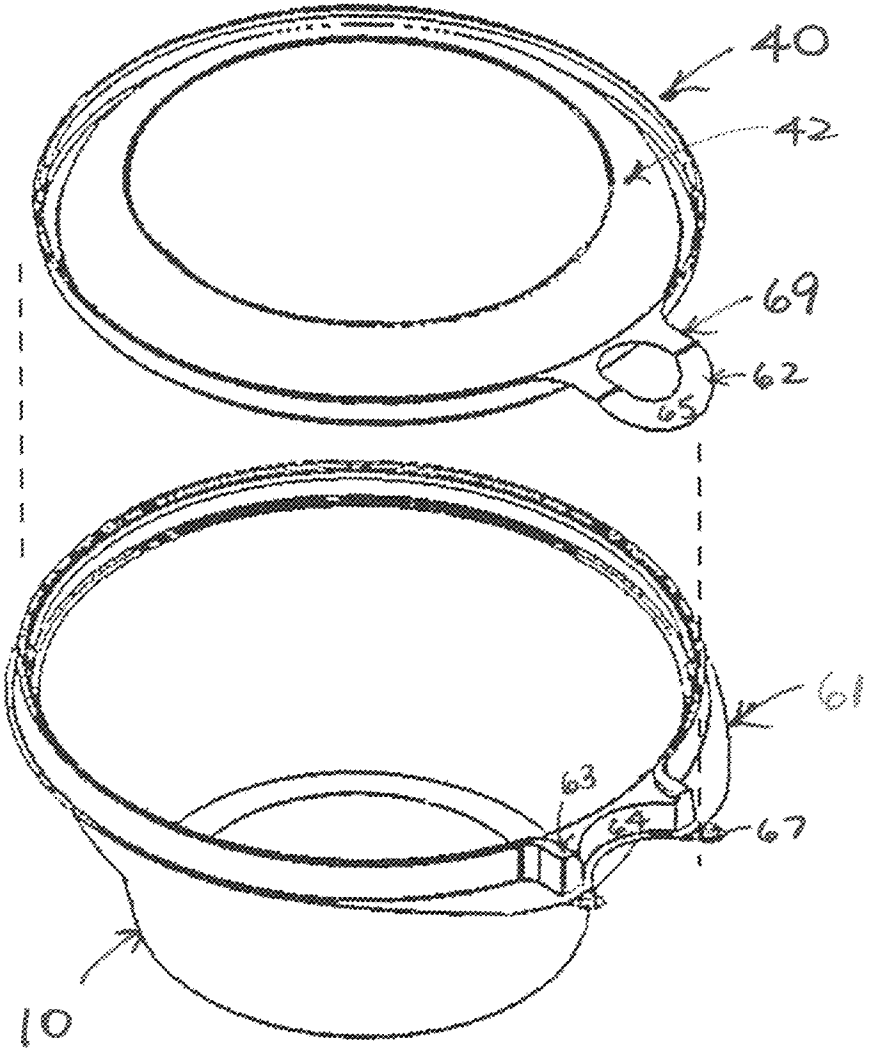
FIG. 7 is a top front perspective of the now two-piece container assembly, formed by separating the initial one-piece food container assembly 5 of FIGS. 1A-1B through 6A-6, with the tamper-evident hinged element 60 broken at the frangible connections FC between the lid flange 69 and base flange 61 as shown in FIG. 6B, and now in a fully opened container position wherein the lid rim 44 has been removed from engagement with the base rim 12 (of the now two-piece container assembly)

2. To initiate closing, a user grasps the base and/or lid and begins to move the lid rim toward the base rim; this movement is allowed by rotation of the hinges of the respective lid and base hinge flanges as previously described (FIGS. 2A-2B).
3. The closing step continues by continuing to move the lid rim toward the base rim as shown in sequence in FIGS. 3A-3B to FIGS. 4A-4B.
4. In the final closing step (FIGS. 5A-5C), the lid hinges are bent 90 degrees and the base hinges are bent 90 degrees with the lid loop portion and base side tabs all now being vertically aligned as previously described, and the lid rim can now be inserted over the base rim to fully close the container. As best shown in the cross section of FIG. 5C, in the fully closed position the lid rim 44 lies over and engages the base rim 12 around the periphery of the container; the lid inner rim wall 45 lies radially inside the base inner rim wall 16 and the lid lip 43 lies over the base top wall 15. The tamper-proof hinge element is disposed as follows:
   a) the lid flanges 69A, 69B are disposed in a horizontal plane parallel to the BRP and lie above and in contact with the top wall of the support element 63, the lid hinges 70A, 70B are each bent 90 degrees downwardly such that the lid loop portion 65 is aligned in the vertical transverse direction T;
   b) the base hinges 68A, 68B are each bent upwardly 90 degrees such that the base side tabs 68A, 68B are now aligned in the vertical transverse direction, along with the finger loop 65 and frangible connections FC therebetween, with the side tabs engaging the post end walls 66A, 66B respectively.
5. When a user wishes to open the closed container, as shown in FIGS. 6A-6B he/she inserts a finger into the open space (loop opening) defined by the arched base support element 63 and the lid finger loop 65, the user pushes radially outwardly and vertically upwardly on the loop 65 with sufficient force to break the two FC connections between the loop 65 and base side posts 66A, 66B; once broken the user continues to move his/her fingertip upwardly under the loop 65, moving the loop upwardly and then applying sufficient force to pull the lid 40 off of the base 10 (i.e., separating the lid rim 44 from the base rim 12).
6. FIG. 7 shows the lid and base now fully separated, enabling the user to remove food from the base recess 11 and/or eat the food right from the recess 11. After eating some portion of the food, the user can then close the lid down over the base, by aligning the lid and base rims and pushing down on the lid rim; the tamper-proof hinge element 60 has been broken and does not interfere with reclosing of the lid onto the base. The lid can late be removed from the base by grasping the finger loop 65 and again pulling upwardly on the loop 65 in order to pull the lid rim off of the base rim.

FIGS. 8A-8B

Figure 8A:
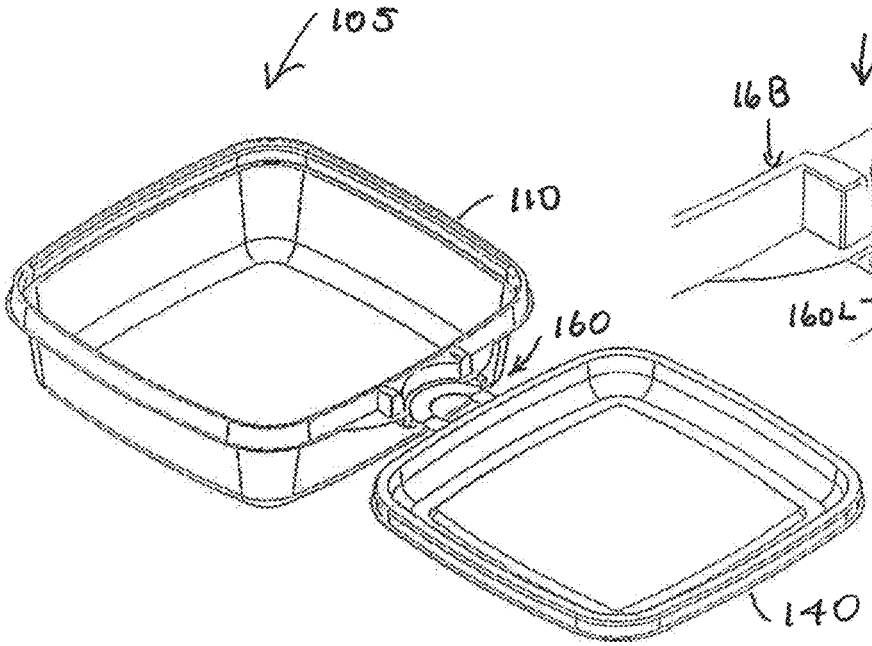
FIG. 8A is a top front perspective view of a one-piece food container assembly according to a second embodiment of the invention wherein the assembly has a rectangular shaped periphery (as opposed to the circular periphery of FIGS. 1A-6B)
Figure 8B:
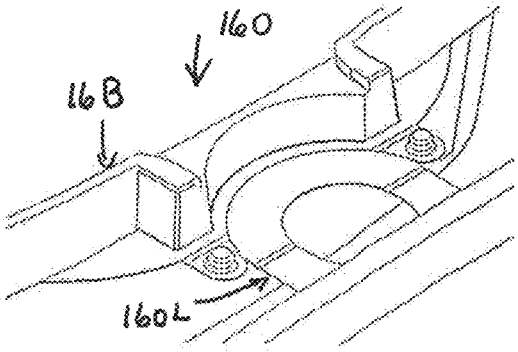

FIGS. 8A-8B are top perspective and enlarged views of a second embodiment which differs from the first in that the peripheries of the container base and lid peripheries are rectangular (e.g., square), rather than circular. In other embodiments the peripheries can be oval, square, hexagonal, triangular or other shapes. Otherwise, the base 110, lid 140 and tamper-proof element 160 operate in the same manner as previously described with respect to the first embodiment. The component parts of the second embodiment are labeled with similar reference numbers as in the first embodiment but in a 100 series of reference numbers.

FIGS. 9A-9G

FIGS. 9A-9G illustrate another embodiment of a one-piece container 205 having square peripheries of the base and lid 210, 240 (similar to FIGS. 8A-8B), but which differs from the prior two embodiments in the structure, configuration and unfolding of the tamper-evident hinged element of the prior embodiments. The third embodiment is configured to provide an initial "push-down" engagement of the ring tab to begin opening of the container (versus the initial "lift-up" engagement of the ring tab in the first and second embodiments). More specifically, the tamper-evident hinged element 260 of the third embodiment has: two sets of hinges 268-1, 268-2; 270-1, 270-2 on each of the base and lid flanges 261, 269 respectively, additional frangible connections FC between the base and lid flanges, the foldable ring tab 262 has an initial folded inward (parallel to the BRP) configuration, and the base flange 261 has elongated tabular extensions 267L, 267L with elongated frangible connections FC to the lid flange 269, for more secure initial engagement. The component parts of the third embodiment are labeled with similar reference numbers as in the first embodiment but in a 200 series of reference numbers.

Figure 9A:
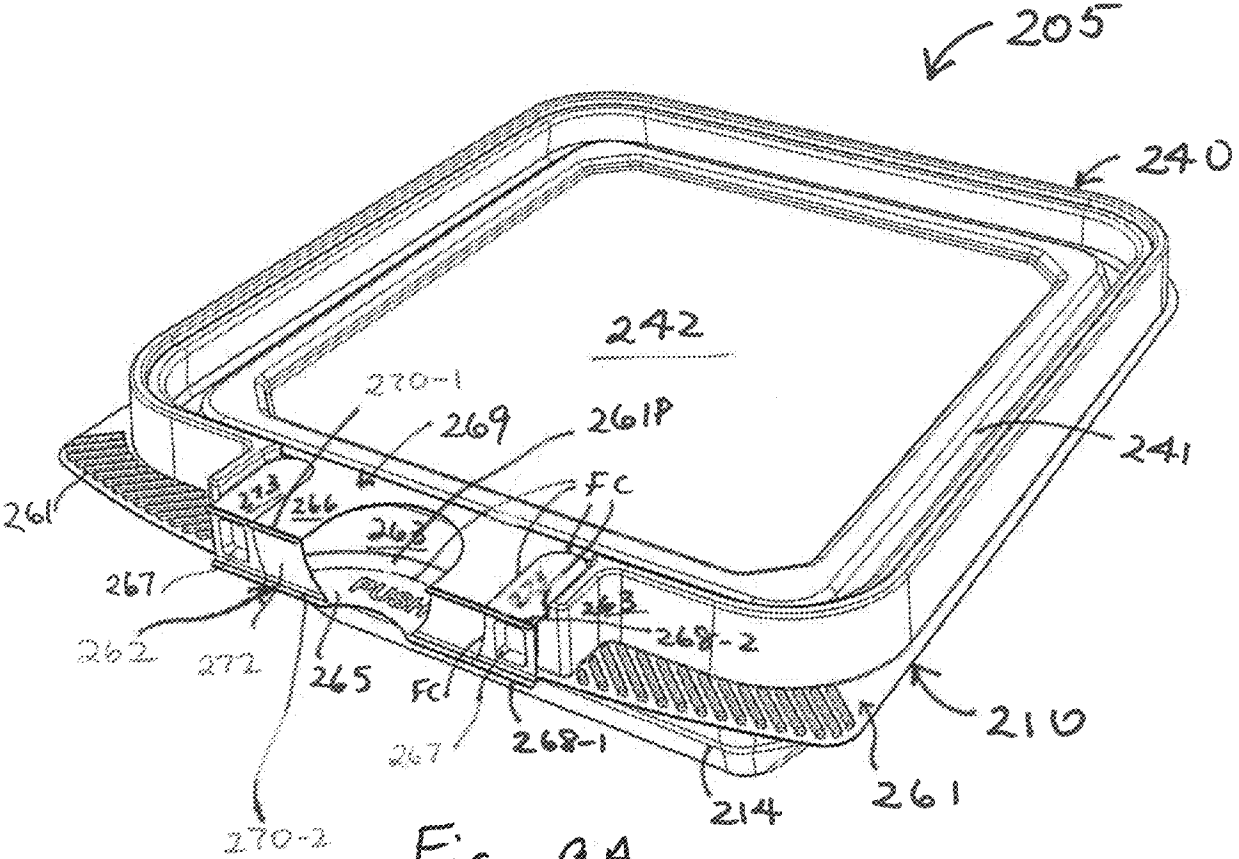
Figure 9C:
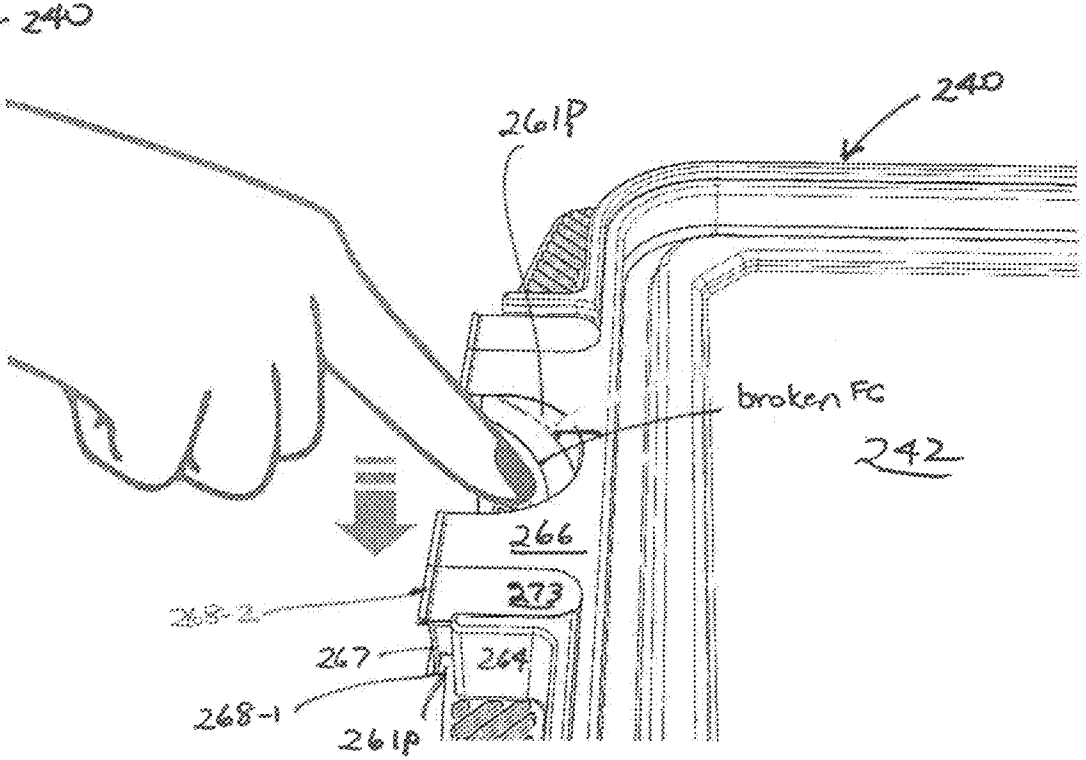
Figure 9B:
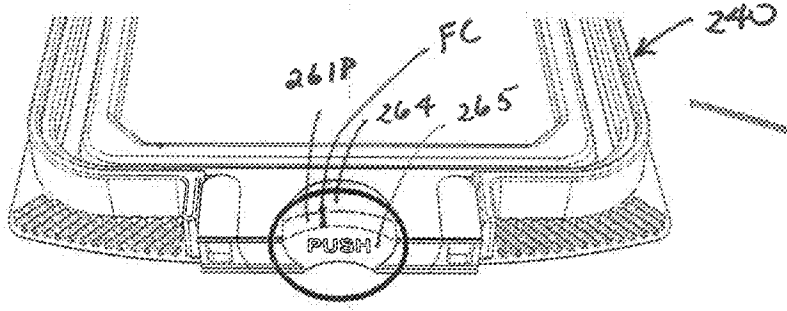

FIG. 9A is a top perspective view of the initially closed container 205, in which: a double-hinged lid flange 269 has an inner/proximal portion 266 of the foldable ring tab extending horizontally (radially outwardly) from the lid periphery, lying in a plane parallel to the BRP; a mid-portion 272 of the foldable ring tab lying vertically (transverse to the proximal portion 266) due to the first hinge 270-1 being bent/folded 90 degrees downwardly with respect to the plane of the proximal portion 265); and the outer/distal portion 265 of the foldable ring tab lying horizontally (transverse to the mid portion 272, and parallel to the proximal portion 265) due to the second hinge 270-2 being bent/folded 90 degrees inwardly with respect to the plane of the mid portion 272). FIG. 9A also shows the initial closed position of the base flange 261, in which: a double-hinged base flange 261 has an inner/proximal portion 261P of the base flange extending horizontally (radially outwardly) from the base periphery, lying in a plane parallel to the BRP; a mid-portion 267 of the base flange lying vertically (transverse to the proximal portion 261P) due to the first hinge 268-1 being bent/folded 90 degrees upwardly with respect to the plane of the proximal portion 261P); and the outer/distal portion 273 of the bae flange lying horizontally (transverse to the mid portion 267, and parallel to the proximal portion 265) due to the second hinge 268-2 being bent/folded 90 degrees inwardly with respect to the plane of the mid portion 267). The elongated base flange thus surrounds the lid flange on three sides, for a more secure engagement. There are frangible connections FC provided between each of: the outer perimeter of the outer/distal portion 265 of the foldable ring tab and the proximal portion 261P of the base flange 261; the outer perimeter of the mid-portion 272 of the foldable ring tab and the mid-portion 267 of the base flange 261; the outer perimeter of the inner/proximal portion 266 of the foldable ring tab and the distal-portion 273 of the base flange 261; the outer perimeter of the distal-portion 273 of the base flange and the fixed support element 263 of the base flange. As shown in FIGS. 9B-9C, all or most of these frangible connections FC may be broken upon initial opening of the container 205.

Figure 9E:
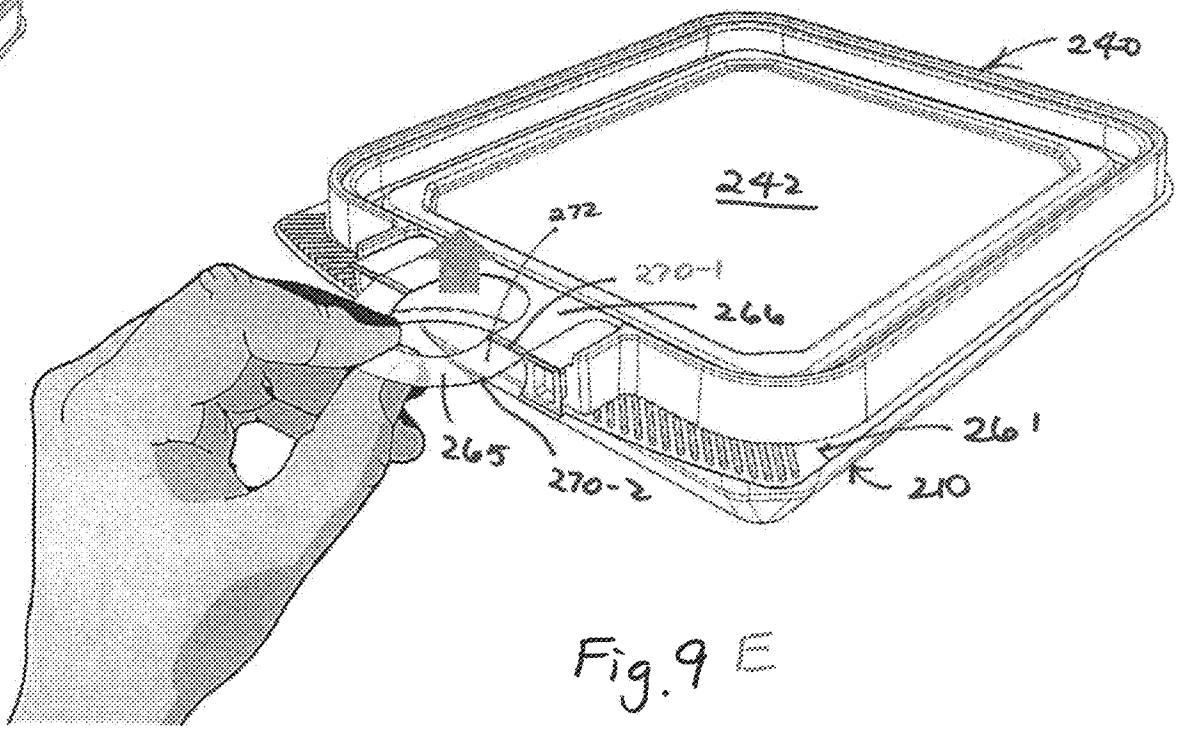
FIGS. 9D-9E show a subsequent step (following FIG. 9C) of rotating outwardly the outer folded portion 65 of the ring tab and lifting the same upwardly to continue opening of the container.
Figure 9D:
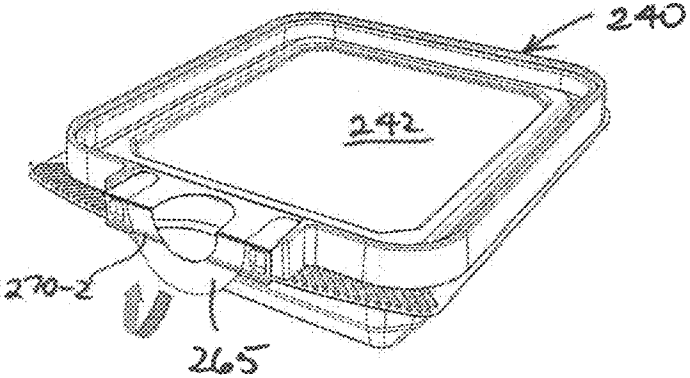
Figure 9F:
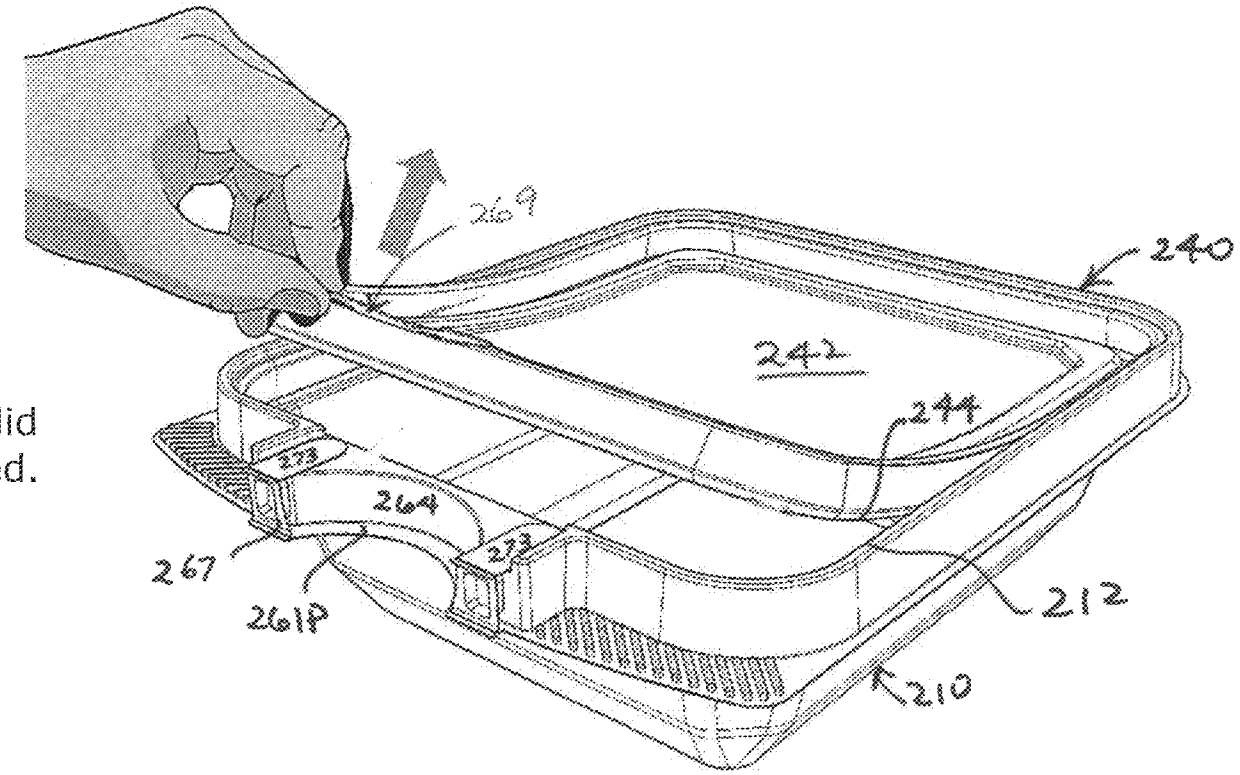
FIG. 9F shows continued upward movement of the ring tab to further break certain FC and begin to unseal the rims of the lid and base.
Figure 9G:
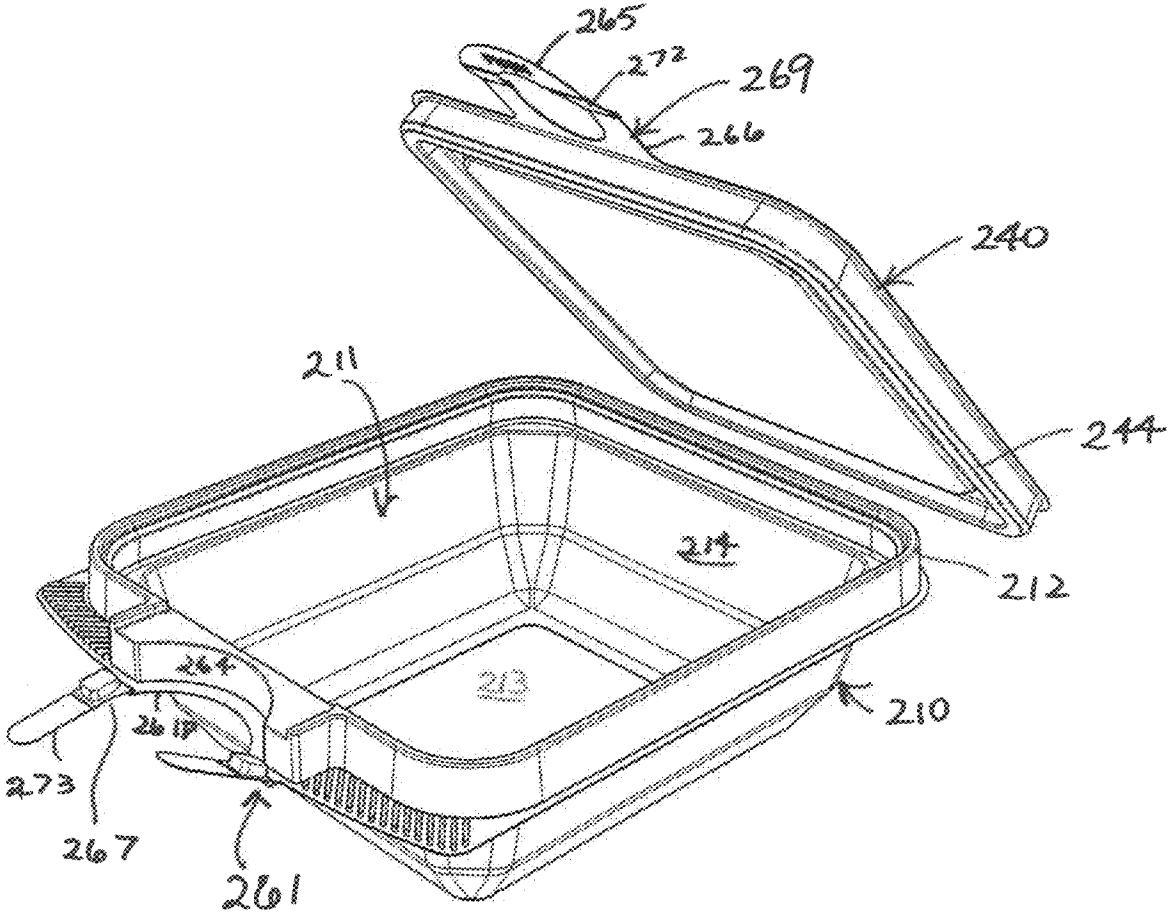
FIG. 9G shows a subsequent step wherein the lid is separated from the base to allow access to the product in the base, the respective base flange 61 and lid flange 69 remaining attached to the base and lid respectively.

FIGS. 9B-9C are top perspective views of the container of FIG. 9A showing the initial step of pushing downwardly on the outer/distal portion 265 (labeled "PUSH") of the ring tab 262, breaking the FC between 261P and 265. FIGS. 9D-9E show the next step (following FIG. 9C) of rotating outwardly the outer/distal now unfolded portion 265 of the ring tab, and then lifting the same (265) upwardly to break the FC between 272 and 267 and continue opening of the container. FIG. 9F shows the subsequent step (following FIG. 9E) of continuing to lift-up the outer/distal portion 265 of the ring tab to break the frangible connecting portions between 266 and 273 and continue opening of the tamper-proof hinged element, and to unseal the rims 244, 212 of the lid and base. FIG. 9G shows the subsequent step of the lid 240 separated from the base 210 to allow access to the product in the base recess 211, the respective hinged elements of the base flange 261 and lid flange 269 remaining attached to the base 210 and lid 240 respectively. The frangible connections FC between the base flange distal-portion 273 lid flange proximal portion 266 may optionally be broken as well, as shown in FIG. 9G. the base flange and lid flange remain connected to the base and lid respectively.

In various embodiments, the one-piece container may comprise a solid polyolefin or polyester based plastic, such as polyethylene terephthalate (PET), polypropylene (PP), polyethylene (PE) or polylactic acid (PLA) based polymers. In one embodiment, the base container may be opaque. In one embodiment the base and lid may comprise molded pulp fiber.

In various embodiments, the one-piece container is made of a solid clear thermoformable plastic, e.g., a polyester such as PET, wherein the plastic is heated, pressed into a mold and then cooled to form the shaped thermoformed container. PET is particularly desirable as it is lightweight and recyclable. Alternatively, the container may be made from polypropylene (PP).

In various embodiments the base and/or lid may comprise multiple compartments, e.g., recessed areas, for receiving different products.

The invention claimed is:

1. A tamper-evident and re-closable container comprising:

a molded single-piece container comprising a base, a lid and a tamper-evident hinged element with frangible connecting portions connecting the base and lid in an initial as-molded open position, the frangible connecting portions when broken allowing separation the base and lid and providing tamper evidence that the container has been previously opened;

the lid and base being movable between:

a) the initial as-molded open position with the lid and base being connected by the hinged element and allowing the base to be filled with a product;

b) an initial closed position with the lid positioned over and temporarily sealed to the base to enclose a product in the closed container, the hinged element allowing relative rotational movement of the base and lid from the initial open position to the initial closed position;

c) an opened position, subsequent to the initial closed position, in which the frangible connecting portions of the hinged element have been broken allowing the base and lid to be separated to allow removal of a product from the base and providing tamper evidence that the container has been opened; and d) a further closed position, subsequent to the opened position, in which the separate base and lid can be resealed to allow storage and subsequent opening of the closed container;

the tamper-evident hinged element comprising mating flanges on perimeter portions of the lid and base that are initially connected by the frangible connecting portions, the mating flanges on the lid and base further comprising hinges that allow for the relative rotational movement of the base and lid from the initial as-molded open position to the initial closed position, the mating flanges including a foldable ring tab having an outer perimeter and foldable extensions adjacent opposing sides of the ring tab outer perimeter, the ring tab outer perimeter being partially formed by the frangible connecting portions for connecting the foldable extensions to the ring tab outer perimeter, the ring tab being configured to be grasped by a user to enable the user to pull the lid from the base and break the frangible connecting portions.

2. The tamper-evident and re-closable container of claim 1, wherein:

the mating flange on the base comprises a fixed support on the base perimeter and the foldable extensions, the foldable extensions being disposed on opposing ends of the fixed support, and the mating flange on the lid comprises the foldable ring tab.

3. The tamper-evident and re-closable container of claim 2, wherein:

the mating flange on the lid comprises hinges for folding the ring tab in the closed position and unfolding the ring tab in the opened position, and the mating flange on the base comprises hinges for folding the extensions in the closed position and unfolding the extensions in the opened position.

4. The tamper-evident and re-closable container of claim 3, wherein:

the frangible connecting portions are disposed on adjacent portions of the mating lid and base flanges and between the respective hinges of the mating flanges.

5. The tamper-evident and re-closable container of claim 4, wherein:

a bottom wall of the base lies in a horizontal base reference plane BRP, an outer folded portion of the ring tab is disposed downwardly transverse to the BRP in the closed position, and the outer folded portion of the ring tab is lifted by pulling outwardly and upwardly away from the lid perimeter to break the frangible connecting portions.

6. The tamper-evident and re-closable container of claim 2, wherein:

the mating flange on the lid comprises two sets of hinges for folding the ring tab in the closed position and unfolding the ring tab in the opened position, and the mating flange on the base comprises two sets of hinges for folding the extensions in the closed position and unfolding the extensions in the opened position.

7. The tamper-evident and re-closable container of claim 6, wherein:

the frangible connecting portions are disposed on adjacent portions of the base flange and a folded portion of the ring tab in the closed position.

8. The tamper-evident and re-closable container of claim 7, wherein:

a bottom wall of the base lies in a horizontal base reference plane BRP, the folded portion of the ring tab and the frangible connecting portions are disposed parallel to the BRP in the closed position, wherein the folded portion of the ring tab is pushed down toward the base plane to break the frangible connections.

9. The tamper-evident and re-closable container of claim 8, wherein:

the extensions on the base flange are folded and the distal portions thereof are disposed in a top reference plane, parallel to the BRP, in the closed position, and frangible connecting portions are disposed between the folded base extensions and the lid flange, wherein the frangible connections on the folded base extensions are broken by pulling the unfolded ring tab upwardly away from the BRP.

10. The tamper-evident and re-closable container of claim 1, wherein:

the mating flange on the lid remains attached to the lid when the frangible connecting portions are broken, and the mating flange on the base remain attached to the base when the frangible connecting portions are broken.

11. The tamper-evident and re-closable container of claim 10, wherein:

the lid and base include re-sealable rims for sealing and unsealing of the lid to the base.

12. The tamper-evident and re-closable container of claim 11, wherein:

the ring tab on the lid is pulled upwardly away from the base plane for subsequent removal of the lid from the base by separating the re-sealable rims.

13. The tamper-evident and re-closable container of claim 1, wherein:

the as-molded container is formed in the open position, with a bottom wall of the base lying in a horizontal base reference plane, and a top wall of the lid lying in a top reference plane that is parallel to the base reference plane.

14. The tamper-evident and re-closable container of claim 13, wherein:

the ring tab and base flange are folded about the hinges on the lid flange and base flange to close the lid over the base in the initially closed position.

15. The tamper-evident and re-closable container of claim 1, wherein:

the base and lid perimeters are rounded or rectangular.

16. A method of forming a tamper-evident and re-closable container comprising:

molding a single-piece container comprising a base, a lid and a tamper-evident hinged element, forming in the mold, or after molding, frangible connecting portions connecting the base and lid in an initial as-molded open position, the frangible connecting portions when broken allowing separation the base and lid and providing tamper evidence that the container has been previously opened;

the tamper-evident hinged element comprising mating flanges on perimeter portions of the lid and base that are initially connected by the frangible connecting portions, the mating flanges on the lid and base further comprising hinges that allow for the relative rotational movement of the base and lid from the initial as-molded open position to an initial closed position, the mating flanges including a foldable ring tab having an outer perimeter and foldable extensions adjacent opposing sides of the ring tab outer perimeter, the ring tab outer perimeter being partially formed by the frangible connecting portions for connecting the foldable extensions to the ring tab outer perimeter, the ring tab being configured to be grasped by a user to enable the user to pull the lid from the base and break the frangible connecting portions;

the lid and base being movable between:

a) the initial as-molded open position with the lid and base being connected by the hinged element and allowing the base to be filled with a product;

b) the initial closed position with the lid positioned over and temporarily sealed to the base to enclose a product in the closed container, the hinged element allowing relative rotational movement of the base and lid from the initial open position to the initial closed position;

c) an opened position, subsequent to the initial closed position, in which the frangible connecting portions of the hinged element have been broken allowing the base and lid to be separated to allow removal of a product from the base and providing tamper evidence that the container has been opened; and d) a further closed position, subsequent to the opened position, in which the separate base and lid can be resealed to allow storage and subsequent opening of the closed container.

* * * * *